US010280734B2

(12) United States Patent
Camacho Cardenas et al.

(10) Patent No.: US 10,280,734 B2
(45) Date of Patent: May 7, 2019

(54) PROXIMITY SENSOR SYSTEM FOR ELECTRIC SUBMERSIBLE PUMPS

(71) Applicant: Schlumberger Technology Corporation, Sugar Land, TX (US)

(72) Inventors: Alejandro Camacho Cardenas, Singapore (SG); Spyro Kotsonis, Singapore (SG); Dudi Abdullah Rendusara, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 372 days.

(21) Appl. No.: 14/787,939

(22) PCT Filed: Apr. 25, 2014

(86) PCT No.: PCT/US2014/035417

§ 371 (c)(1),
(2) Date: Oct. 29, 2015

(87) PCT Pub. No.: WO2014/179160

PCT Pub. Date: Nov. 6, 2014

(65) Prior Publication Data

US 2016/0084069 A1 Mar. 24, 2016

Related U.S. Application Data

(60) Provisional application No. 61/816,986, filed on Apr. 29, 2013.

(51) Int. Cl.
*E21B 43/12* (2006.01)
*E21B 47/00* (2012.01)
(Continued)

(52) U.S. Cl.
CPC ..... *E21B 47/0007* (2013.01); *E21B 43/128* (2013.01); *F04D 13/06* (2013.01);
(Continued)

(58) Field of Classification Search
CPC ..... F04D 13/06; F04D 13/086; F04D 13/10; F04D 15/0077; F04D 15/0088;
(Continued)

(56) References Cited

U.S. PATENT DOCUMENTS 6,811,382 B2 11/2004 Buchanan et al.
7,215,252 B2 * 5/2007 Schenck ..... F01D 11/06 324/623

(Continued)

FOREIGN PATENT DOCUMENTS

JP 2001090688 A 4/2001

OTHER PUBLICATIONS

European Search Report issued in related EP application 14792249.6 dated Aug. 12, 2016, 6 pages.

(Continued)

*Primary Examiner* — David E Sosnowski
*Assistant Examiner* — Sang K Kim

(57) ABSTRACT

An electric submersible pump (ESP) can include a shaft; an electric motor configured to rotatably drive the shaft; a housing; a stack of diffusers disposed in the housing; impellers disposed in the housing and operatively coupled to the shaft; and a proximity sensor operatively coupled to the housing.

20 Claims, 12 Drawing Sheets

(51) Int. Cl.

| | |
|---|---|
| ***F04D 13/10*** | (2006.01) |
| ***F04D 15/00*** | (2006.01) |
| ***F04D 13/06*** | (2006.01) |
| ***F04D 29/08*** | (2006.01) |
| ***F04D 29/44*** | (2006.01) |
| ***F04D 29/52*** | (2006.01) |
| ***F04D 13/08*** | (2006.01) |
| *F04D 29/043* | (2006.01) |
| *F04D 29/18* | (2006.01) |
| *F04D 29/62* | (2006.01) |

(52) U.S. Cl.
CPC ..... *F04D 13/086* (2013.01); *F04D 13/10* (2013.01); *F04D 15/0077* (2013.01); *F04D 15/0088* (2013.01); *F04D 15/0094* (2013.01); *F04D 29/086* (2013.01); *F04D 29/445* (2013.01); *F04D 29/528* (2013.01); *F04D 29/043* (2013.01); *F04D 29/18* (2013.01); *F04D 29/622* (2013.01)

(58) Field of Classification Search
CPC ..... F04D 15/0094; F04D 15/0272; F04D 29/086; F04D 29/445; F04D 29/528; F04D 29/043; F04D 29/18; F04D 29/622; E21B 47/0007; E21B 43/128
See application file for complete search history.

(56) References Cited

U.S. PATENT DOCUMENTS

| | | | | |
|---|---|---|---|---|
| 7,648,332 | B2 | 1/2010 | Eslinger et al. | |
| 2002/0066568 | A1 | 6/2002 | Buchanan et al. | |
| 2007/0252717 | A1* | 11/2007 | Fielder | E21B 47/0007 340/648 |
| 2009/0180866 | A1 | 7/2009 | Bourgeois et al. | |
| 2010/0256953 | A1* | 10/2010 | Kar | G05B 23/0221 702/185 |
| 2010/0288493 | A1 | 11/2010 | Fielder et al. | |
| 2011/0044831 | A1 | 2/2011 | Cunningham et al. | |
| 2011/0052432 | A1* | 3/2011 | Cunningham | F04D 13/10 417/423.3 |
| 2011/0231110 | A1* | 9/2011 | Johnston | G01M 5/0033 702/34 |
| 2011/0255951 | A1 | 10/2011 | Song et al. | |
| 2012/0257995 | A1 | 10/2012 | True | |
| 2013/0148127 | A1* | 6/2013 | Sheth | G01N 21/47 356/446 |

OTHER PUBLICATIONS

Article 94(3) EPC issued in related EP application 14792249.6 dated Sep. 27, 2016, 6 pages.
Schlumberger, Phoenix MultiSensor xt150, Brochure, 2011, 10-AL-0129 (2 pages).
Schlumberger, Phoenix SoloConn and ARConn, Brochure, 2012, 11-AL-0092 (3 pages).
Schlumberger, REDA Hotline, Brochure, 2011, 11-AL-0062 (3 pages).
Schlumberger, Advanced ESP Lifting Service, Brochure, 2008, 08-AL-042 (1 page).
Schlumberger, SpeedStar MVD, Brochure, 2016, 15-AL-43886 (2 pages).
Schlumberger, WellWatcher UniConn, Brochure, 2016, 16-CO-224868 (2 pages).
Schlumberger, WellWatcher BriteBlue HT, Brochure, 2014, 13-CO-0050 (2 pages).
Schlumberger, OPTICall, Distributed Temperature Sensing. On Demand., Brochure, 2009, 09-TS-0277 (8 pages).
American Petroleum Institute (API), Recommended Practice on Electric Submersible Pump System Vibrations, API Recommended Practice 11S8 (RP11S8), First Edition, May 1, 1993 (17 pages).
Schlumberger, Case Study, Extremely Abrasive Colombia Well Produces for 797 Days with a Rugged Maximus ESP System, 2017, 17-AL-285610 (2 pages).
PCT/US2014/035417, PCT International Preliminary Report on Patentability (IPRP), dated Nov. 3, 2015 (9 pages).

* cited by examiner

PROXIMITY SENSOR SYSTEM FOR ELECTRIC SUBMERSIBLE PUMPS

RELATED APPLICATIONS

This application claims priority to and the benefit of a U.S. Provisional Patent Application having Ser. No. 61/816,986, filed 29 Apr. 2013, which is incorporated herein by reference.

BACKGROUND

An electric submersible pump (ESP) can include a stack of impeller and diffuser stages where the impellers are operatively coupled to a shaft driven by an electric motor. Various phenomena exist during operation as fluid is propelled from lower stages to upper stages of the ESP stack. Various technologies, techniques, etc. described herein may help to monitor and/or control operation of an ESP.

SUMMARY

An electric submersible pump (ESP) can include a shaft; an electric motor configured to rotatably drive the shaft; a housing; a stack of diffusers disposed in the housing; impellers disposed in the housing and operatively coupled to the shaft; and a proximity sensor operatively coupled to the housing. As an example, the proximity sensor may be a shaft speed sensor, a shaft displacement sensor or an impeller vane speed sensor.

An electric submersible pump (ESP) can include a shaft; an electric motor configured to rotatably drive the shaft; a housing; a stack of diffusers disposed in the housing; impellers disposed in the housing and operatively coupled to the shaft where the impellers form hydraulic seals with respect to the diffusers; and a proximity sensor operatively coupled to the housing. As an example, the proximity sensor may be a hydraulic seal sensor or a diffuser sensor.

An electric submersible pump (ESP) can include a shaft; an electric motor configured to rotatably drive the shaft; a protector operatively coupled to the electric motor where the protector includes a bellows; a housing; a stack of diffusers disposed in the housing; impellers disposed in the housing and operatively coupled to the shaft; and a proximity sensor operatively coupled to the protector where the proximity sensor may be a bellows sensor.

An electric submersible pump (ESP) can include a shaft; an electric motor configured to rotatably drive the shaft; a protector operatively coupled to the electric motor where the protector includes a shaft seal; a housing; a stack of diffusers disposed in the housing; impellers disposed in the housing and operatively coupled to the shaft; and proximity sensor operatively coupled to the protector where the proximity sensor may be a shaft seal sensor.

An electric submersible pump (ESP) can include a shaft; an electric motor configured to rotatably drive the shaft; a protector operatively coupled to the electric motor where the protector includes a thrust bearing; a housing; a stack of diffusers disposed in the housing; impellers disposed in the housing and operatively coupled to the shaft; and a proximity sensor operatively coupled to the protector where the proximity sensor may be a thrust bearing sensor.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
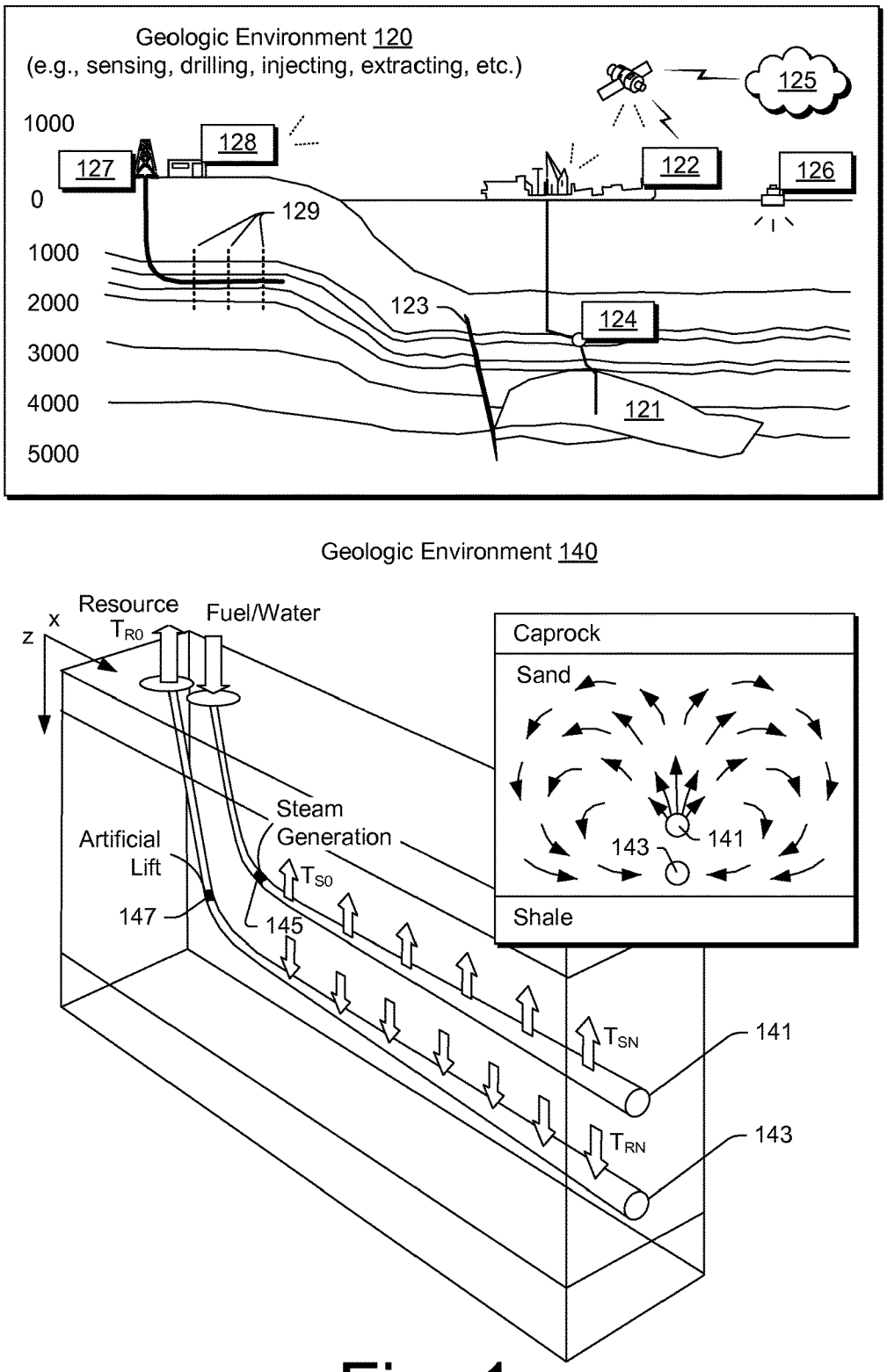
FIG. 1 illustrates examples of equipment in geologic environments.

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP).

As illustrated in a cross-sectional view of FIG. 1, steam injected via the well 141 may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 (e.g., an ESP) may then assist with lifting the resource in the well 143 to, for example, a surface facility (e.g., via a wellhead, etc.). As an example, where a production well includes artificial lift equipment such as an ESP, operation of such equipment may be impacted by the presence of condensed steam (e.g., water in addition to a desired resource). In such an example, an ESP may experience conditions that may depend in part on operation of other equipment (e.g., steam injection, operation of another ESP, etc.).

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over a significant period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

Figure 2:
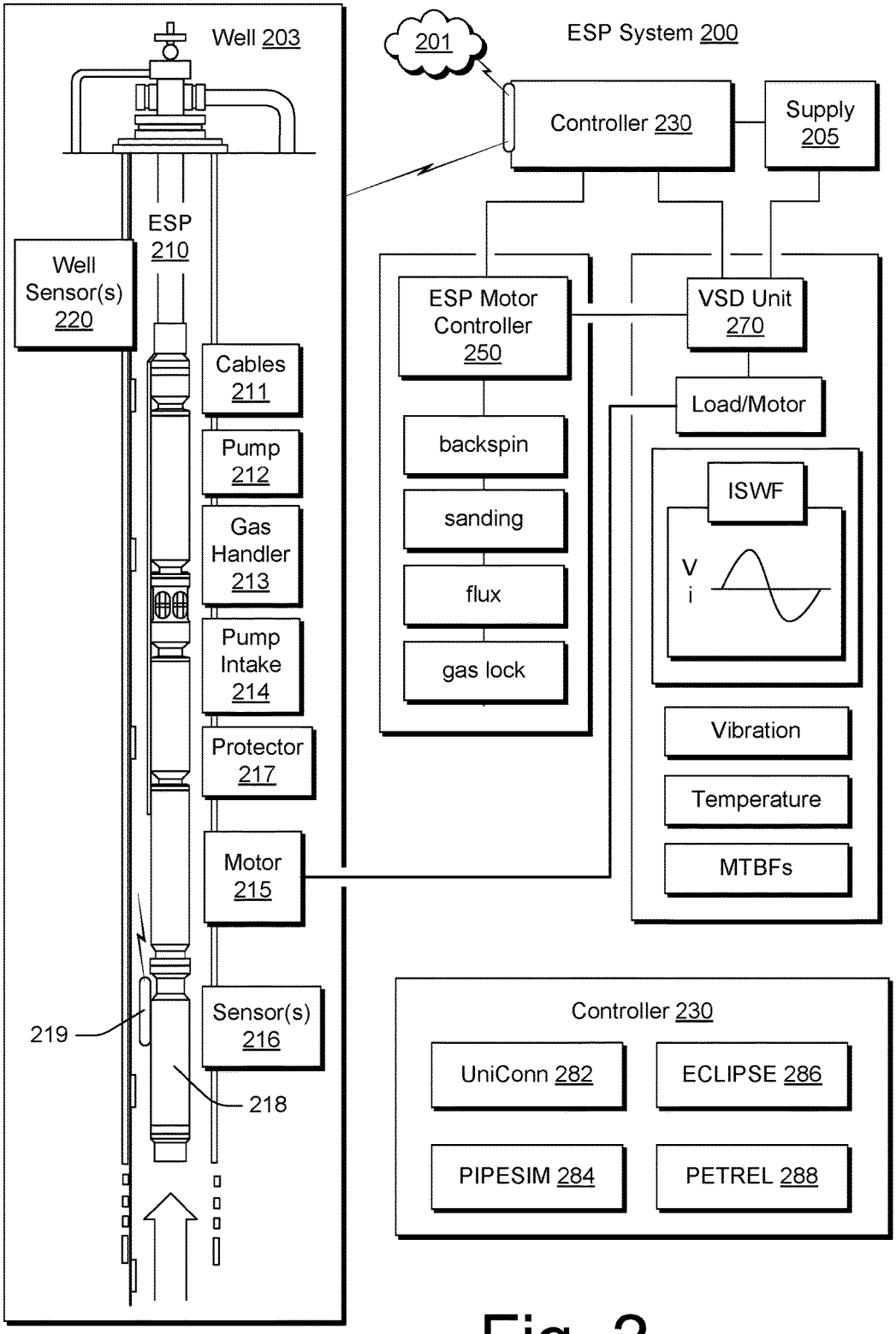
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, commercially available ESPs (such as the REDA™ ESPs marketed by Schlumberger Limited, Houston, Tex.) may find use in applications that call for, for example, pump rates in excess of about 4,000 barrels per day and lift of about 12,000 feet or more.

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source. The power supply 205 may supply a voltage, for example, of about 4.16 kV.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and optionally a protector 217. As shown, the ESP 210 can include a gauge 218 that may be a unit for one or more of the one or more sensors 216 and the gauge 218 may include communication circuitry 219 that can include transmission circuitry and/or reception circuitry.

As an example, an ESP may include a REDA™ Hotline high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

In the example of FIG. 2, the well 203 may include one or more well sensors 220, for example, such as the commercially available OpticLine™ sensors or WellWatcher BriteBlue™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 4,000 feet or more) and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UniConn™ motor controller 282 marketed by Schlumberger Limited (Houston, Tex.). In the example of FIG. 2, the controller 230 may access one or more of the PIPESIM™ framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UniConn™ motor controller. The UniConn™ motor controller can connect to a SCADA system, the espWatcher™ surveillance system, etc. The UniConn™ motor controller can perform some control and data acquisition tasks for ESPs, surface pumps or other monitored wells. The UniConn™ motor controller can interface with the Phoenix™ monitoring system, for example, to access pressure, temperature and vibration data and various protection parameters as well as to provide direct current power to downhole sensors (e.g., sensors of a gauge, etc.). The UniConn™ motor controller can interface with fixed speed drive (FSD) controllers or a VSD unit, for example, such as the VSD unit 270.

For FSD controllers, the UniConn™ motor controller can monitor ESP system three-phase currents, three-phase surface voltage, supply voltage and frequency, ESP spinning frequency and leg ground, power factor and motor load.

For VSD units, the UniConn™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP, flux of an ESP and gas lock of an ESP. The motor controller 250 may include any of a variety of features, additionally, alternatively, etc.

In the example of FIG. 2, the VSD unit 270 may be a low voltage drive (LVD) unit, a medium voltage drive (MVD) unit or other type of unit (e.g., a high voltage drive, which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SpeedStar™ MVD control circuitry marketed by Schlumberger Limited (Houston, Tex.).

Figure 3:
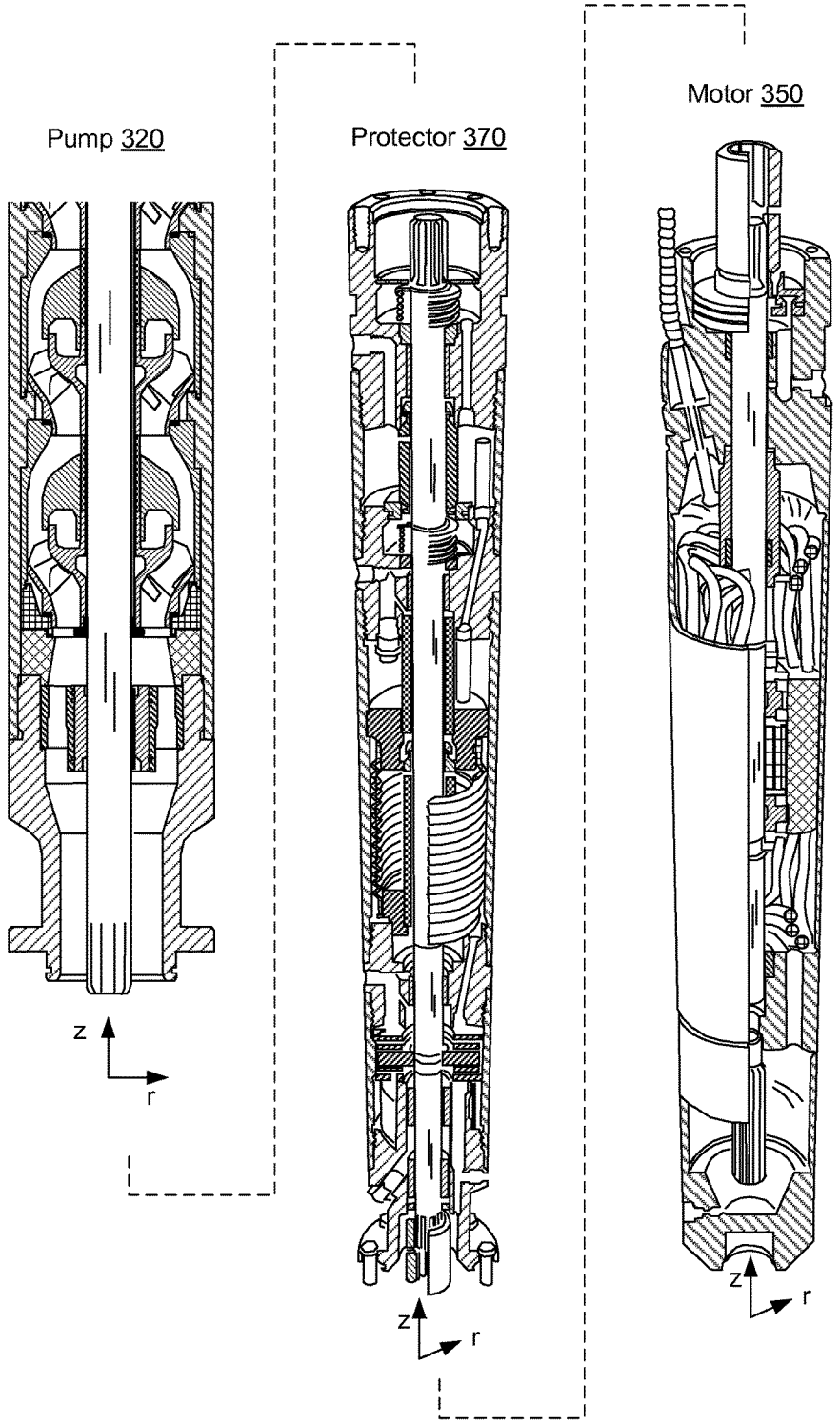
FIG. 3 illustrates examples of equipment.

FIG. 3 shows cut-away views of examples of equipment such as, for example, a portion of a pump 320, a protector 370 and a motor 350 of an ESP. The pump 320, the protector 370 and the motor 350 are shown with respect to cylindrical coordinate systems (e.g., r, z, Θ). Various features of equipment may be described, defined, etc. with respect to a cylindrical coordinate system. As an example, a lower end of the pump 320 may be coupled to an upper end of the protector 370 and a lower end of the protector 370 may be coupled to an upper end of the motor 350. As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle. Orientation of an ESP with respect to gravity may be considered as a factor, for example, to determine ESP features, operation, etc.

Figure 4:
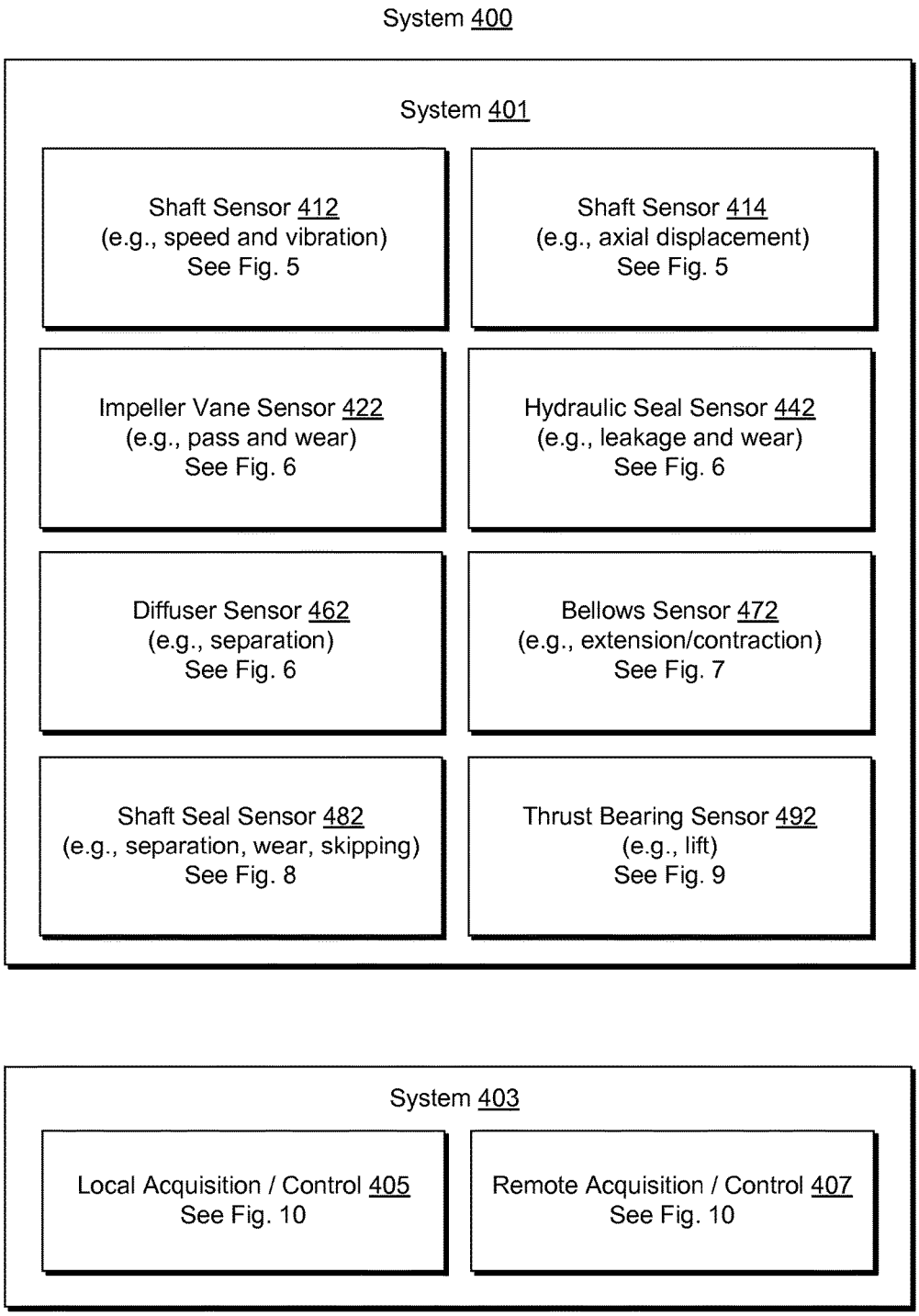
FIG. 4 illustrates an example of a system that includes one or more sensors.

FIG. 4 shows a block diagram of an example of a system 400 that can include a system 401 and a system 403. As shown in FIG. 4, the system 401 can include a shaft sensor 412 configured for speed and/or vibration sensing, a shaft sensor 414 configured for axial displacement sensing, an impeller vane sensor 422 configured for vane pass speed and/or vane wear sensing, a hydraulic seal sensor 442 configured for leakage and/or wear sensing, a diffuser sensor 462 configured for separation sensing, a bellows sensor 472 configured for expansion and/or contraction sensing, a shaft seal sensor 482 configured for separation, wear and/or skipping sensing and/or a thrust bearing sensor 492 configured for lift sensing. As an example, the one or more sensors 412, 414, 422, 442, 462, 472, 482 and 492 may be part of equipment such as equipment that can be deployed in a downhole environment. For example, the system 401 may be a sensor system for an ESP. As an example, one or more of the sensors 412, 414, 422, 442, 462, 472, 482 and 492 may be a proximity sensor.

In the example of FIG. 4, the system 403 can include one or more acquisition and/or control modules 405 and 407. Such modules may be operatively coupled to one or more of the sensors 412, 414, 422, 442, 462, 472, 482 and 492 for acquisition of information and optionally control of equipment. For example, the system 400 may include one or more of the sensors 412, 414, 422, 442, 462, 472, 482 and 492 operatively coupled to an ESP where the one or more sensors 412, 414, 422, 442, 462, 472, 482 and 492 can sense information and where at least a portion of such information may be acquired by one or more of the acquisition and/or control modules 405 and 407, for example, for control of operation of the ESP.

Figure 5:
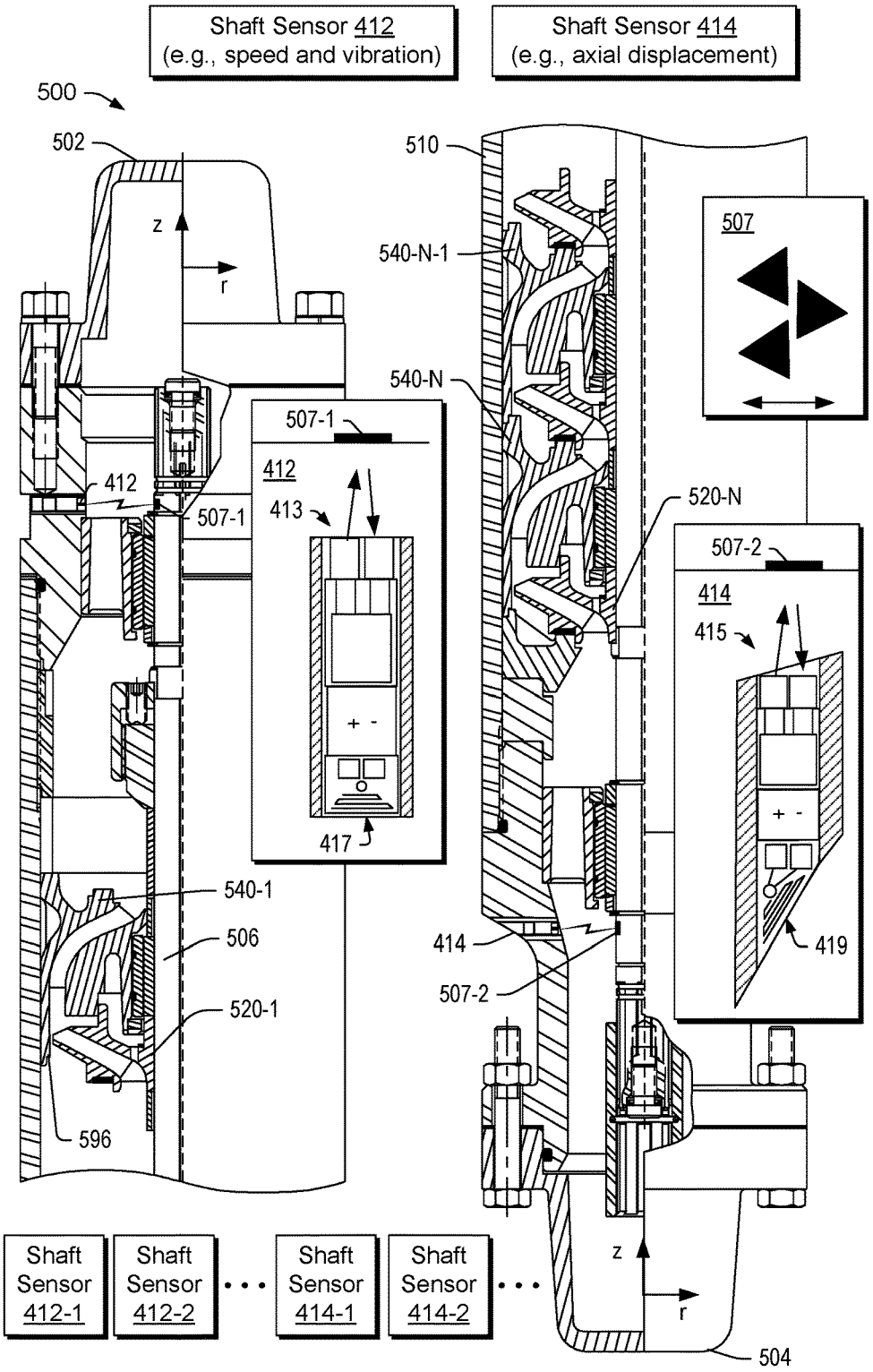
FIG. 5 illustrates an example of a system that includes one or more sensors.

FIG. 5 shows cutaway views of a system 500 that includes the shaft sensor 412 and the shaft sensor 414. As shown the system 500 includes an end cap 502 and an end cap 504 that are fit to ends of a housing 510 that houses various components of a pump such as a shaft 506, impellers 520-1 to 520-N and diffusers 540-1 to 540-N. The end caps 502 and 504 may be employed to protect the system 500, for example, during storage, transport, etc.

In the example of FIG. 5, rotation of the shaft 506 (e.g., about a z-axis) can rotate the impellers 520-1 to 520-N to move fluid upwardly where such fluid is guided by the diffusers 540-1 to 540-N. As an example, a pump stage may be defined as an impeller and a diffuser, for example, the impeller 520-1 and the diffuser 540-1 may form a pump stage. In the example of FIG. 5, flow in each stage may be characterized as being mixed in that flow is both radially and axially directed by each of the impellers 520-1 to 520-N and each of the diffusers 540-1 to 540-N (see, e.g., the r, z coordinate system).

As an example, the shaft sensor 412 may be mounted in an opening of the housing 510 and include an end directed toward the shaft 506. As shown, the shaft sensor 412 includes circuitry 413 such as, for example, emitter/detector circuitry, power circuitry and communication circuitry 417. As an example, power circuitry may include power reception circuitry, a battery or batteries, power generation circuitry (e.g., via shaft movement, fluid movement, etc.), etc. As an example, communication circuitry, such as the communication circuitry 417, may include an antenna or antennas, wires, etc. As an example, communication circuitry may be configured to communication information (e.g., receive and/or transmit) via wire (e.g., conductor or conductors) or wirelessly. As such, the communication circuitry 417 can be reception circuitry and/or transmission circuitry.

As an example, the shaft 506 may include a marker 507-1 that can reflect energy emitted by an emitter of the shaft sensor 412 where such reflected energy may be detected by a detector of the shaft sensor 412. For example, an emitter may be an electromagnetic energy emitter that can emit energy at one or more wavelengths (e.g., IR, VIS, UV, etc.). As an example, an emitter may be an LED, a laser or other emitter. As an example, a detector may be an electromagnetic energy detector that can detect energy at one or more wavelengths (e.g., IR, VIS, UV, etc.). As an example, the shaft 506 may be fit with a reflector strip as the marker 507-1 such that rotation of the shaft 506 may allow the shaft sensor 412 to sense rotation of the shaft 506 by passage of the reflector strip in front of an emitter/detector of the shaft sensor 412. For example, where the shaft 506 of the system 500 (e.g., without the end caps 502 and 504) is operatively coupled to a motor, rotational speed of the shaft 506 may be sensed via the shaft sensor 412.

As an example, the circuitry 413 of the shaft sensor 412 may include vibration sensing circuitry. For example, the circuitry 413 may include a detector array that can sense spatial deviations in reflected energy over time while the shaft 506 is rotating. Such a detector array may be a linear array or a matrix array and may interact with one or more markers 507-2 of the shaft 506. As an example, in absence of vibration, reflected energy may be detected as having a peak with respect to one or more detector elements of the array; whereas, in presence of vibration, reflected energy may be detected as having a peak or peaks that move with respect to the detector elements. In such an example, greater movement of peak reflected energy with respect to time may indicate larger amplitude vibrations. Further, a frequency analysis of detected energy with respect to time with respect to one or more detector elements may indicate one or more vibration frequencies.

As to control, where shaft vibration is detected at a particular rotational speed of the shaft 506, power to a motor operatively coupled to the shaft 506 may be adjusted to alter the rotational speed, for example, in an effort to reduce the shaft vibration. In such an example, the shaft sensor 412 may be part of a feedback control loop. In such an example, vibration reduction may improve pump performance, pump longevity, etc.

As to the shaft sensor 414, it can include circuitry 415 such as, for example, emitter/detector circuitry, power circuitry and communication circuitry 419. As an example, the shaft 506 may include a marker that can be tracked by the shaft sensor 414 to sense axial movement of the shaft 506 (e.g., along the z-axis). Such information may be germane to positions of one or more of the impellers 520-1 to 520-N with respect to positions of one or more of the diffusers 540-1 to 540-N.

As an example, where a shaft is supported by one or more bearings, walking, shifting, etc. of the shaft with respect to the one or more bearings may be related to rotational speed, load, etc. For example, a shaft may "walk up" (e.g., ride up, etc.) with respect to a bearing in a manner dependent on shaft rotational speed. As an example, a shaft may seat in a bearing in a manner that depends on one or more operational conditions (e.g., shaft rotational speed, fluid properties, load, etc.). In such an example, a shaft may change in its radial position, axial position or radial and axial position with respect to a bearing. As an example, a shaft displacement sensor may be configured to sense one or more of axial and radial position of a shaft. In such an example, where a change in shaft speed occurs, a change in axial and/or radial position of the shaft (e.g., optionally with respect to a bearing, etc.) may be used to determine axial and/or radial displacement of the shaft.

As to control, where shaft axial movement is detected at a particular rotational speed of the shaft 506, power to a motor operatively coupled to the shaft 506 may be adjusted to alter the rotational speed, for example, in an effort to reduce the axial shaft movement. In such an example, the shaft sensor 414 may be part of a feedback control loop. In such an example, reduction of axial movement of the shaft 506 may improve pump performance, pump longevity, etc.

As shown in FIG. 5, the system 500 may include one or more sensors such as one or more of the sensors 412 (e.g., 412-1, 412-2, etc.) and/or one or more of the sensors 414 (e.g., 414-1, 414-2, etc.).

As an example, a marker or markers may be characterized by shape, orientation, material of construction, etc. As an example, consider the marker 507 which includes a plurality of marker elements arranged in a pattern that has a different profile for clockwise and counter-clockwise rotations. As an example, a marker may be constructed from a magnetic material, for example, to interact with a proximity sensor that can detect movement of a magnetic field, presence of a magnetic field, proximity of a magnetic field, etc. As an example, a magnet moving in space may induce a current in a detector of a sensor. In such an example, a sensor may act as a detector without emitting energy. As an example, where a fluid may carry ferromagnetic particles, a magnetic marker may be configured with a relatively weak magnetic field, for example, where gravity, force of fluid flow, etc. may overcome magnetic attraction between such particles and the magnetic marker such that the particles do not collect on the magnetic marker.

As an example, a sensor may emit energy that is affected by presence of a marker, proximity of a marker, movement of a marker, etc. As an example, a marker may be made of or include a conductive material, a non-conductive material or a combination of conductive and non-conductive material.

As an example, a marker may be part of a shaft or other rotating component where the mass of the marker is negligible, where markers are positioned to balance the shaft or component, etc. For example, consider a shaft with three markers positioned at 120 degree intervals, which may act to balance a shaft where the markers are approximate equal in mass.

As an example, a proximity sensor may be configured to detect presence of an object without direct contact with the object (e.g., a non-contact sensor). In such an example, an object may be a component, a marker or other object. As an example, a proximity sensor may detect a clearance (e.g., a gap) between objects or, for example, adjacent to an object. As an example, a sensor may employ a contact mechanism to determine proximity or, for example, lack thereof, with respect to an object. For example, consider a strain gauge that can measure strain with respect to two components where the strain depends on proximity of one of the components with respect to the other one of the components.

As another example, an electrical contact strip may break where proximity is lost. For example, an electrical contact strip may be mounted to two components with or without slack such that loss of proximity (e.g., gap formation, etc.) between the components causes the electrical contact strip to break (e.g., where the gap exceeds strain tolerated by the strip, slack of the strip, etc.). As an example, a series of electrical contact strips may be employed, optionally with different values of resistance (e.g., ohms). In such an example, a current that passes through the strips may change as one or more of the strips breaks (e.g., consider resistors in parallel). For example, a circuit may be formed using electrical contact strips of different lengths and resistances (e.g., resistance per unit length, etc.) where the circuit is coupled to or across two components. In such an example, as the two components move away from each other individual strips may break successively to alter resistance in the circuit where one or more measurements using the circuit may infer or determine how large of a gap exists between the two components.

Figure 6:
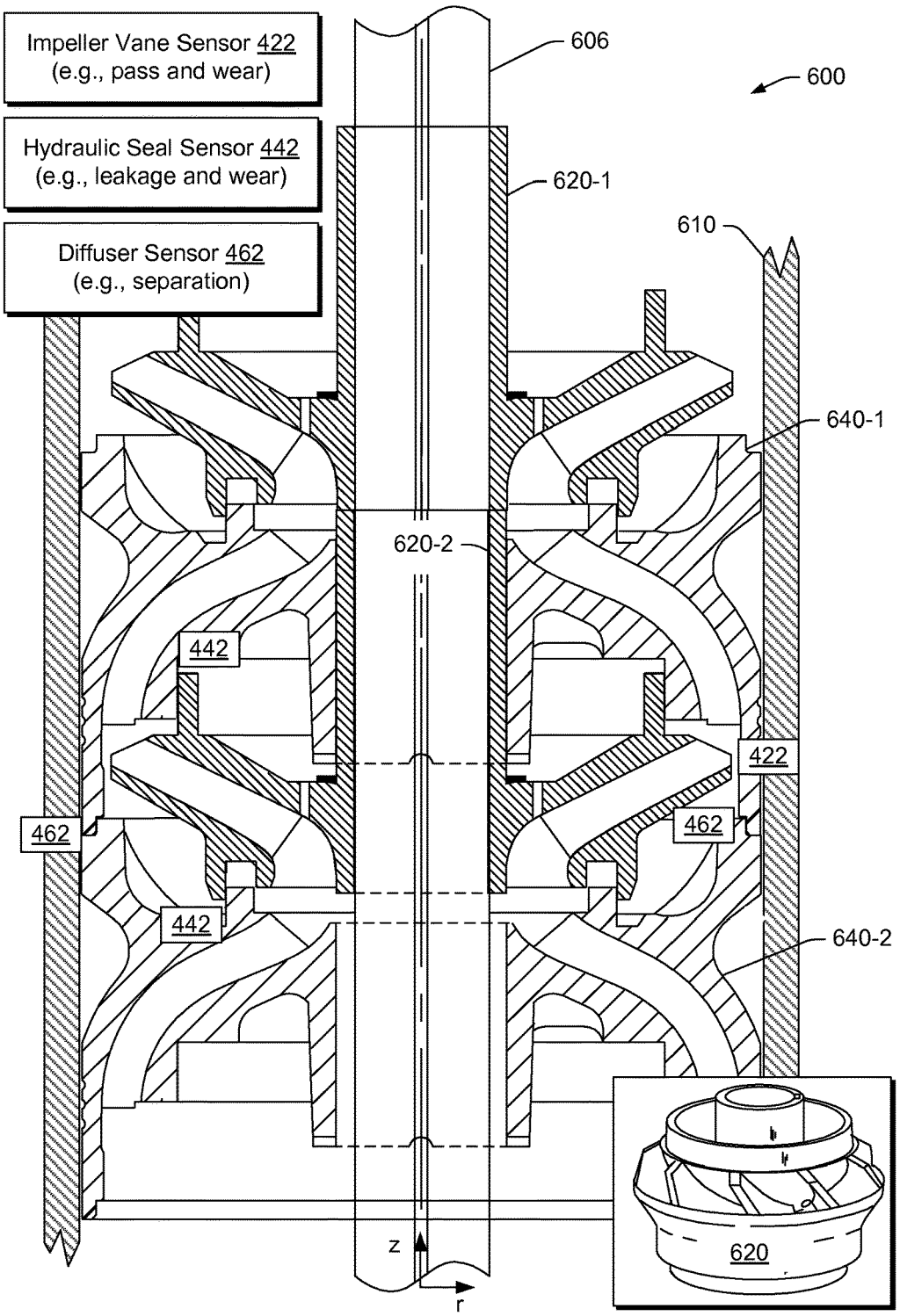
FIG. 6 illustrates an example of a system that includes one or more sensors.

FIG. 6 shows a cross-sectional view of an example of a system 600 that includes at least one pump stage housed in a housing 610 and also shows a perspective view of an example of an impeller 620. As shown, a shaft 606 extends along a z-axis and is fitted with impellers 620-1 and 620-2. The impeller 620-1 can receive fluid via a diffuser 640-1 and the impeller 620-2 can receive fluid via a diffuser 640-2.

The system 600 of FIG. 6 can include one or more of the impeller vane sensor 422, the hydraulic seal sensor 442 and the diffuser sensor 462. Each of the sensors 422, 442 and 462 can include circuitry such as, for example, emitter/detector circuitry, power circuitry and communication circuitry.

As an example, the impeller vane sensor 422 may be positioned with respect to the diffuser 640-1 and/or the housing 610 and be aimed at the impeller 620-2. As shown, the impeller vane sensor 422 may be at an axial level that aligns with vane edges of the impeller 620-2. In such an example, as the impeller 620-2 rotates (e.g., as driven by the shaft 606), the impeller vane sensor 422 may sense passage of each vane of the impeller 620-2.

As an example, the impeller vane sensor 422 may include emitter/detector circuitry such as that described with respect to the sensor 412. As an example, circuitry of the impeller vane sensor 422 may be configured to detect electromagnetic energy, optionally via an induction mechanism. For example, the impeller vane sensor 422 may emit an electric and/or magnetic field where passage of a vane through the field causes a field disturbance that may be sensed by the sensor 422 and thus associated with passage of a vane.

As an example, where a vane may experience wear over time, the impeller vane sensor 422 may detect a change in energy associated with that vane (e.g., or vanes). As an example, an impeller may include about 8 vanes and the impeller vane sensor 422 may be configured to characterize each of the vanes based at least in part on one or more sensed signal characteristics. In such an example, the impeller vane sensor 422 may optionally track individual vanes as to vane wear. As an example, a statistical analysis may be applied to one or more vanes of an impeller. In such an example, the statistical analysis may result in one or more metrics that are germane to vane wear of vanes collectively and/or individually.

As to the hydraulic seal sensor 442, such a sensor may include circuitry such as emitter/detector circuitry, power circuitry and communications circuitry. As an example, the hydraulic seal sensor 442 may include pressure detection circuitry, flow detection circuitry, clearance detection circuitry or other circuitry capable of detecting a condition germane to sealing. As shown, the hydraulic seal sensor 442 may be mounted to a diffuser such as the diffuser 640-1 and the diffuser 640-2. As an example, during operation, where leakage occurs or change in leakage occurs in a seal between an impeller and a diffuser, the hydraulic seal sensor 442 may sense such leakage or change in leakage.

As to the diffuser sensor 462, as shown in FIG. 6, the diffusers 640-1 and 640-2 may be axially stacked. As an example, the diffusers 640-1 and 640-2 may be stacked in a manner where they are in contact with each other and/or where a diffuser spacer may be employed. In such examples, the diffuser sensor 462 may sense separation (e.g., gap formation) between a diffuser and another diffuser and/or a diffuser spacer.

The diffuser sensor 462 can include one or more types of circuitry. As an example, the diffuser sensor 462 may include a strip that breaks if axial spacing increases between two diffusers. As an example, the diffuser sensor 462 may include a strain sensor that can sense strain responsive to an increase in axial spacing between two diffusers. As an example, the diffuser sensor 462 may include a gap detection circuit that can sense gap formation, an increase in gap distance, etc., as may be associated with axial spacing of adjacent diffusers.

Figure 7:
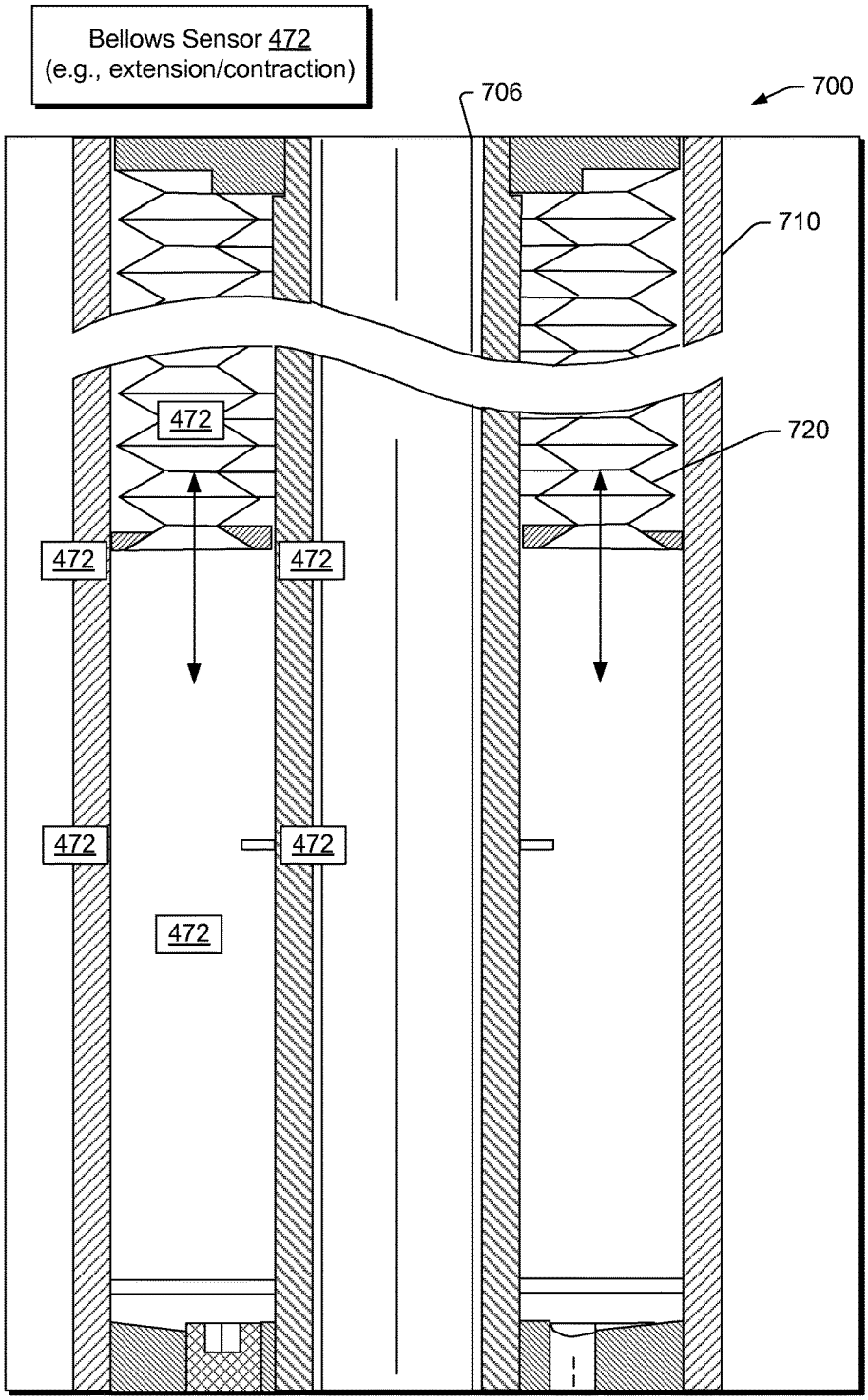
FIG. 7 illustrates an example of a system that includes one or more sensors.

FIG. 7 shows an example of a system 700 that includes a shaft 706, a housing 710, a bellows 720 and one or more of the bellows sensors 472. As an example, the system 700 may be part of a protector such as the protector 370 of FIG. 3. In such an example, fluid pressures may change in a manner that causes the bellows 720 to expand or contract. Fluid pressure changes may occur in response to one or more changes in conditions. For example, operational speed of a motor of an ESP, position of an ESP with respect to gravity, leakage of motor oil, etc.

As an example, the bellows sensor 472 may include strain detection circuitry, for example, to detect strain associated with expansion of the bellows 720 and/or associated with contraction of the bellows 720. As an example, the bellows sensor 472 may include position detection circuitry that may detect position of a portion of the bellows 720. For example, the system 700 of FIG. 7 is shown as optionally including a plurality of the bellows sensors 472 at different axial positions.

As an example, a bellows sensor 472 may include emitter/detector circuitry, power circuitry and communication circuitry. In such an example, the bellows sensor 472 may operate as a rangefinder, for example, to determine a distance between the bellows sensor 472 and a portion of the bellows 720. For example, the bellows sensor 472 may be fixed at an axial position and include an emitter that is directed axially toward a portion of the bellows 720. In such an example, a detector of the bellows sensor 472 may detect emitted energy that is reflected by that portion of the bellows 720 to determine how far that portion of the bellows 720 is from the position of the bellows sensor 472.

Figure 8:
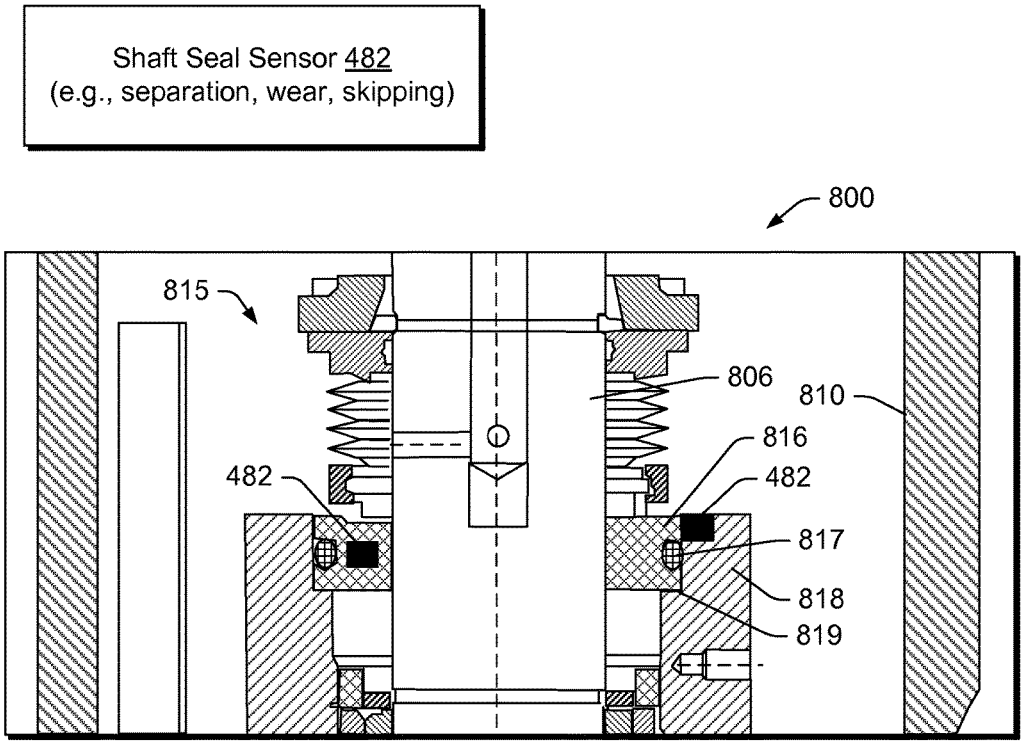
FIG. 8 illustrates an example of a system that includes one or more sensors.

FIG. 8 shows an example of a system 800 that includes a shaft 806, a housing 810, a shaft seal assembly 815 and one or more shaft seal sensors 482. As shown in the example of FIG. 8, the shaft seal assembly 815 includes a component 816 that includes a seal element 817 where the component 816 is seated with respect to a component 818 that includes a seat 819. As shown, the seat 819 includes an annular surface with a shoulder that extends axially upwardly along a cylindrical face that is in contact with the seal element 817. In the example of FIG. 8, the component 816 defines two spaces, a lower space and an upper space, which are sealed from each other at least in part by the seal element 817. In such an example, where the sealing function of the shaft seal assembly 815 remains intact, fluid in the lower space may not flow to the upper space and fluid in the upper space may not flow to the lower space.

In the example of FIG. 8, the shaft seal sensor 482 may include circuitry such as a break strip (e.g., conductive circuit breaker strip), a strain detector, a position detector, a pressure detector, etc. For example, where the component 816 is displaced with respect to the component 818, a break strip may break, which may trigger a signal, a strain detector may detect strain, a position detector may detect a change in position, a pressure detector may detect a change in pressure, etc. As to pressure, for example, consider a pressure differential between the lower space and the upper space that may be detected by the shaft seal sensor 482. In such an example, a breach of the seal formed by the shaft seal assembly 815 may result in a change in the pressure differential that can be sensed by the shaft seal sensor 482.

As to skipping of the component 816 with respect to the component 818, the shaft seal sensor 482 may be positioned to detect azimuthal orientation of the component 816 with respect to the component 818. For example, where rotation of the shaft 806 causes force to be applied to the component 816 that may cause the component 816 to "skip" (e.g., move azimuthally) with respect to the component 818, the shaft seal sensor 482 may detect such a change in position.

As to wear of the shaft seal assembly 815, one or more types of circuitry may be employed by the shaft seal sensor 482. For example, where vibration of the component 816 with respect to the component 818 increases, the shaft seal sensor 482 may sense such vibration as an indicator of wear.

As an example, the shaft seal sensor 482 may be configured to sense separation, wear and skipping of the component 816 with respect to the component 818.

Figure 9:
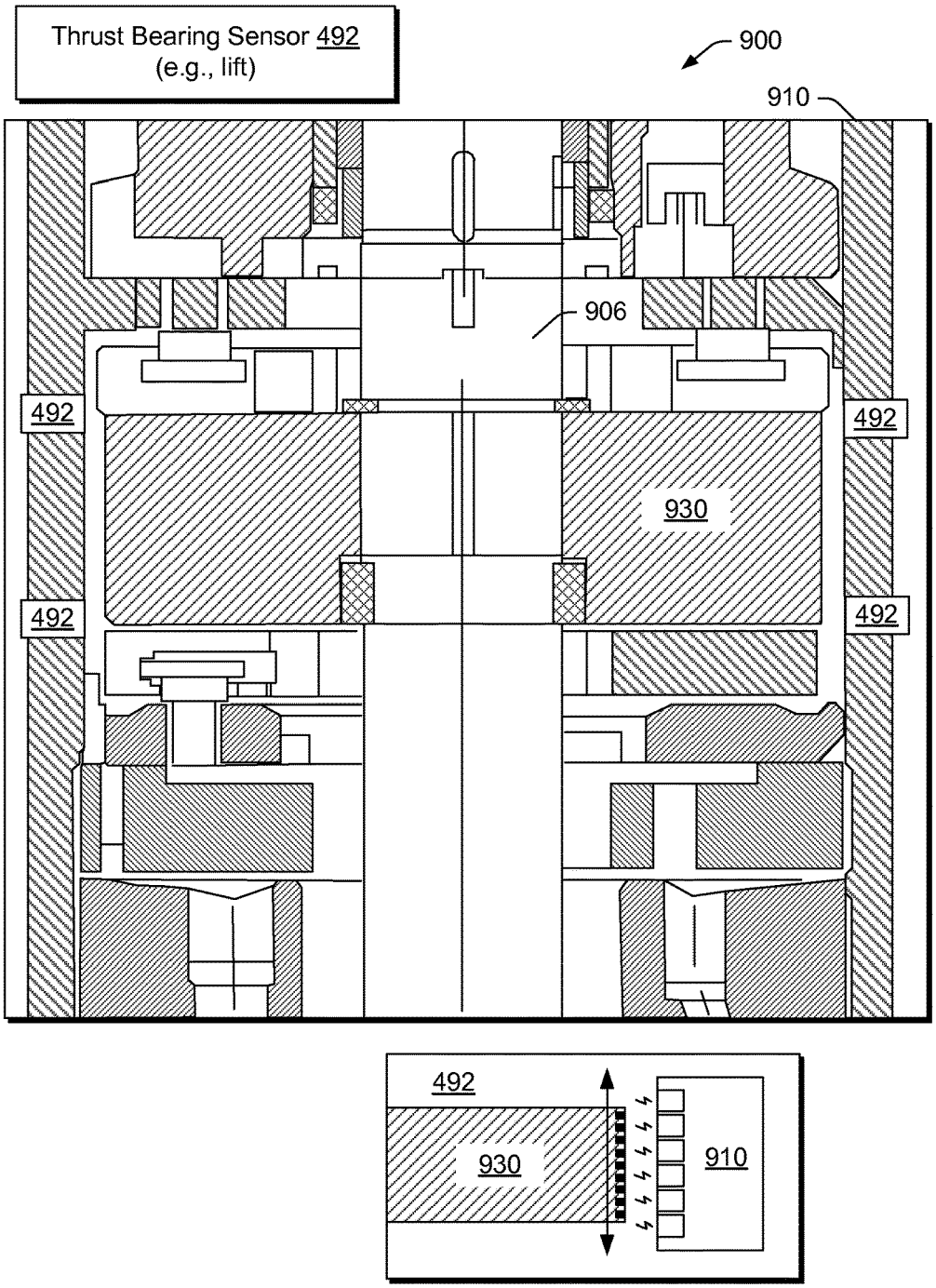
FIG. 9 illustrates an example of a system that includes one or more sensors.

FIG. 9 shows an example of a system 900 that includes a shaft 906, a housing 910, a thrust bearing 930 and one or more of the thrust bearing sensors 492. As an example, the thrust bearing sensor 492 may be configured to sense lift of the thrust bearing 930, for example, with respect to the housing 910. As an example, the thrust bearing sensor 492 may include circuitry such as, for example, emitter/detector circuitry, power circuitry and communication circuitry. As an example, the thrust bearing sensor 492 may include an array, for example, consider a linear array of emitters and/or detectors. In such an example, axial lift (e.g., axial position) of the thrust bearing 930 with respect to the housing 910 may be detected.

Figure 10:
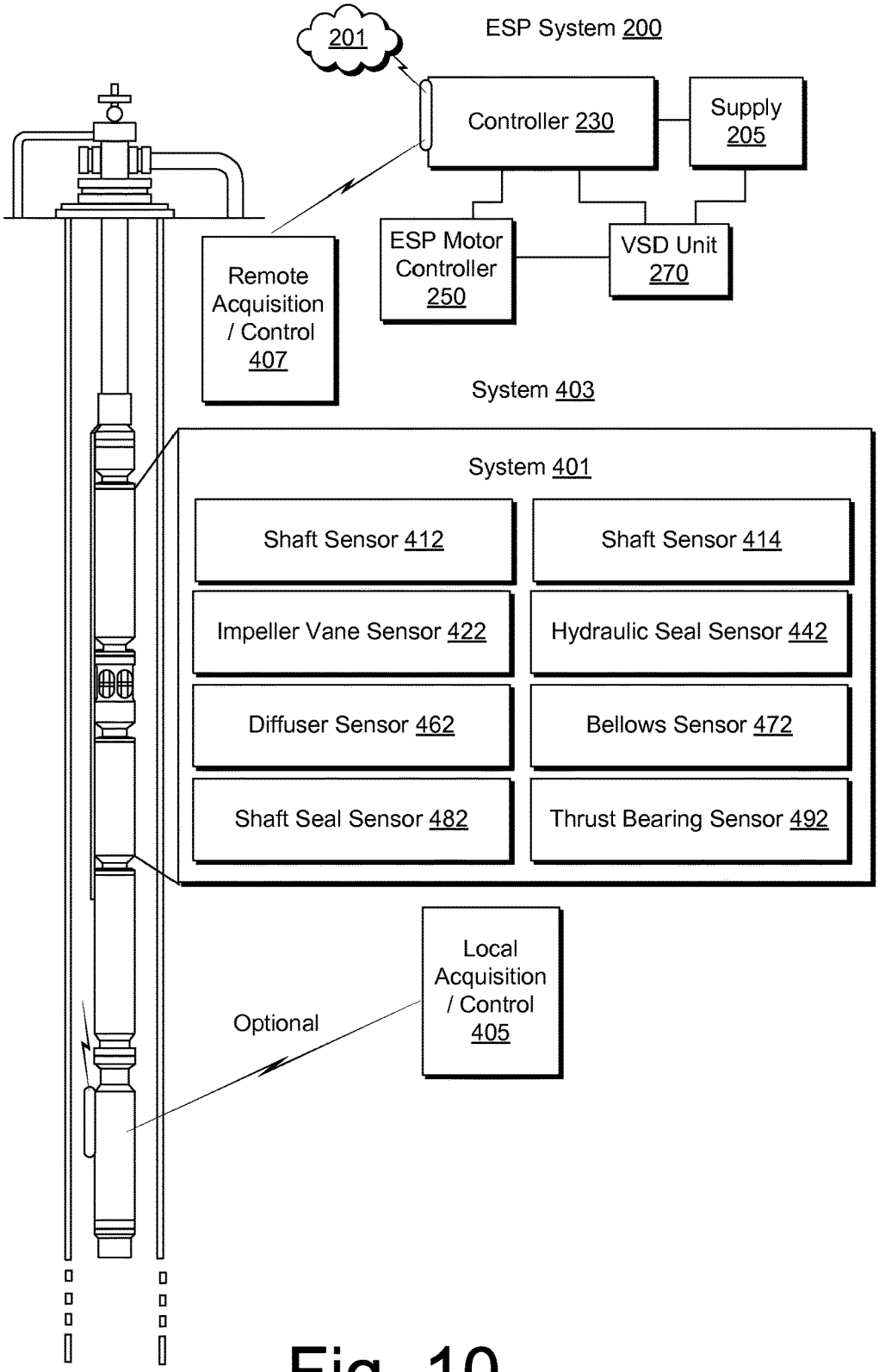
FIG. 10 illustrates an example of a system that includes one or more sensors.

FIG. 10 shows an example of the ESP system 200 as including one or more features of the system 401 and one or more features of the system 403. For example, the ESP system 200 may include one or more of the sensors 412, 414, 422, 442, 462, 472, 482 and 492 and may include one or more of the modules 405 and 407.

Figure 11:
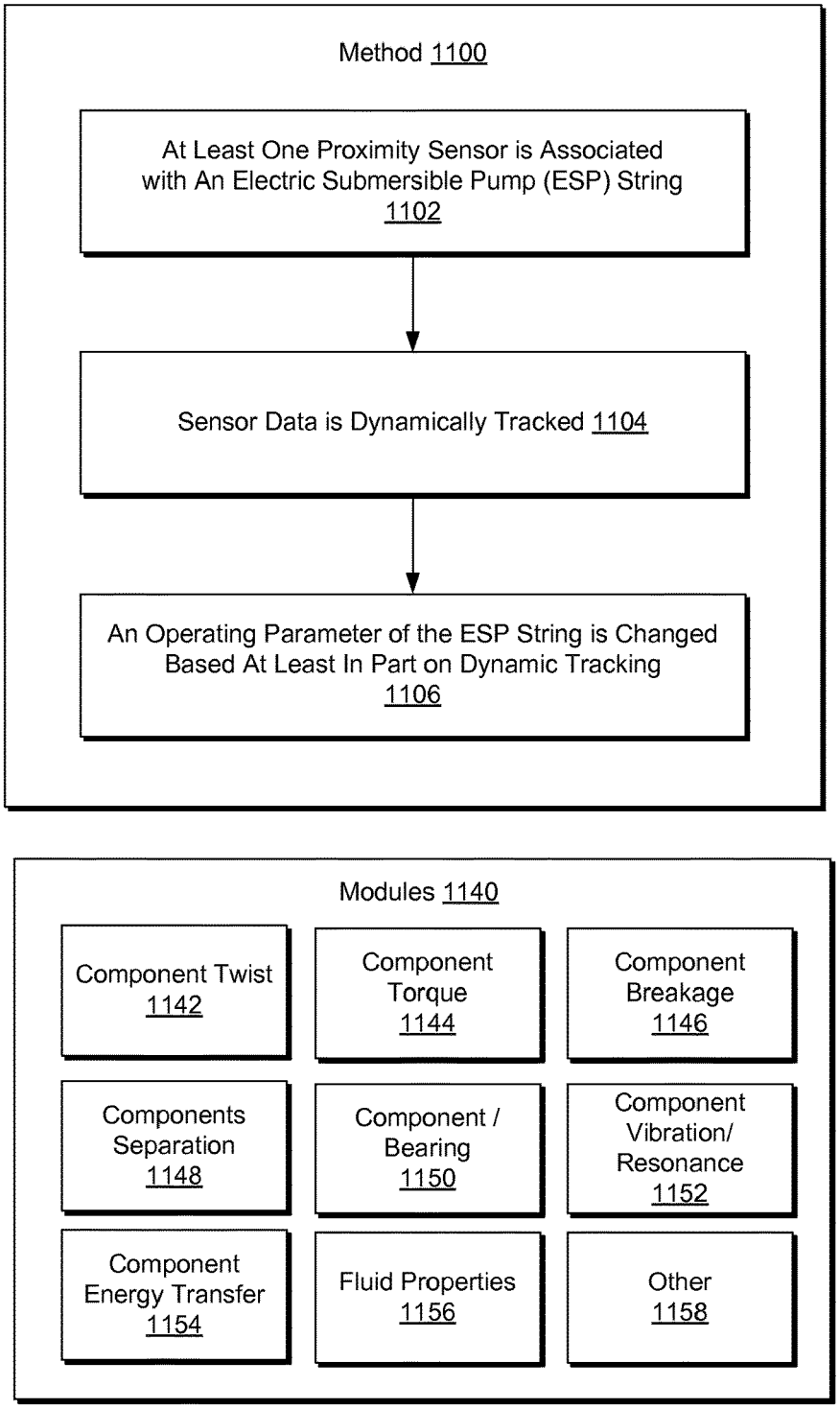
FIG. 11 illustrates an example of a method and examples of modules.

FIG. 11 shows an example of a method 1100 that includes a sensor block 1102 where at least one proximity sensor is associated with an electric submersible pump (ESP) string, a sensor data block 1104 where sensor data is dynamically tracked and an operating parameter block 1106 where an operating parameter of the ESP string is changed based at least in part on dynamic tracking of sensor data. For example, a method may include providing an ESP string that includes at least one proximity sensor, tracking sensor data from at least one of the proximity sensors (e.g., with respect to time) and changing at least one operating parameter of the ESP string (e.g., a component or components thereof, etc.) based at least in part on the tracked sensor data.

FIG. 11 also shows some examples of modules 1140 that may be provided as part of a system, for example, to receive sensed information and to output information based at least in part on the received sensed information where such output information may optionally be used to change one or more operating parameters (e.g., of an ESP, ESPs, ESP-related equipment, etc.).

In the example of FIG. 11, the modules 1140 include a component twist modules 1142, a component torque module 1144, a component breakage module 1146, a components separation module 1148, a component/bearing interaction module 1150, a component vibration/resonance module 1152, a component energy transfer modules 1154, a fluid properties modules 1156 and optionally one or more other modules 1158. As an example, a modules library may be provided, which may be accessible by a system, for example, to load one or more modules for monitoring equipment, for controlling equipment, etc. A module may include instructions storable in memory and executable by a processor, for example, to perform mathematical computations where output therefrom may be based at least in part on input thereto.

As an example, a method may include acquiring sensor data from which speed and vibration of a shaft may be inferred or determined. As an example, a method may include acquiring data sensor data from which rotational direction of a shaft may be inferred or determined. For example, consider the markers 507 of FIG. 4, which may be configured in shape and/or spatial arrangement to provide information as to rotational direction (e.g., clockwise rotation or counter-clockwise rotation of a shaft). As an example, a shaft may include multiple markers where the markers differ in one or more characteristics (e.g., shape, orientation, relationship to another marker, material of construction, etc.). As an example, a marker may include a shape or shapes that give it a leading profile that differs from a trailing profile (e.g., with respect to a direction of rotation). As an example, a system may include a sensor that can sense two or more markers where at least two of the markers may have different shapes. As an example, a system may include two sensors axially located with respect to a shaft where the shaft includes a respective marker for each of the sensor where offset angles determined via sensed data may allow for inference or determination of a rotational direction of the shaft.

As an example, a method may include acquiring sensor data and determining shaft twist. For example, a system may include a plurality of position sensors at various shaft axial locations. In such an example, where the shaft includes markers (e.g., or a marker that extends over an axial a distance), information sensed by the sensors may allow for determination of shaft twist. For example, where a distance between two markers increases, which may be noted by times for the two markers, the increase in distance may indicate shaft twist. As an example, shaft torque may be derived from one or more shaft twist measurements. As an example, by measuring shaft twist in real time, torque transients may be derived (e.g., startup dynamics, load dynamics, shaft torsional vibration, etc.). As an example, feedback to a controller may allow for control of twist, torque, etc.

As an example, a system may include axial shaft sensors where at least one is located above and at least one is located below an element, for example, as part of a mechanism to determine torque load of the element (e.g., by analyzing twist, etc.). As an example, such an element may be a thrust bearing. In such an example, information as to behavior of a thrust bearing (or thrust bearings), which may be positioned with respect to a protector and motor, may be used to correlate to thrust load (e.g., estimate thrust load being carried by one or more thrust bearings).

As an example, a system may include multiple axial shaft sensors where information acquired therefrom may provide for detection of shaft breakage. For example, where information indicates that one or more lower shaft sensor markers are spinning at a different speed (or speeds) than one or more top shaft sensor markers, it may be determined that there is severe loss of shaft twist on loose sections, less severe loss of shaft twist on still engaged sections, etc.

As an example, twist may be determined with respect to one or more lengths, sections, etc. of a shaft. For example, multiple rotational sensors may be implemented to sense information for twist calculations. As an example, a twist calculation may be performed over one or more relatively large portions of a shaft's length, which may allow for determinations such as, for example, the bottom rotates more due to being driven by the motor and the top has a substantial lag due to the "break" of transferring rotational torque from the shaft to the impellers and in turn the transfer of rotational mechanical energy to axial energy of the fluid. As an example, rotational twist of the shaft lack uniformity due to multiple dynamic effects. In such an example, a plurality of rotational sensors may be used to determine a twisted shape (e.g., or shapes) of a shaft.

Example methods or an example sensor system for electric submersible pumps (ESPs) may aim to improve instrumentation of an ESP. An example system may be configured to interpret proximity sensor data to determine operating parameters that correlate to ESP health and running conditions. In such an example, the system may apply a corrective or intervention based on the proximity sensor data and the interpretation to improve performance or extend the run life of the hardware.

An example system may use proximity sensors (e.g., one or more of the sensor of the system 401) to capture data on ESP running conditions. In an implementation, sensors can be mounted on a plurality of ESP subsystems such as the motor, protector (seal section and compensator) and pumps. Measurements related to a shaft or shafts may include rpm, vibration and axial displacement. Sensors may be configured to determine a wear rate of one or more pump stages such as hydraulic seal wear and vane erosion. As an example, protector health can be monitored by measuring gaps in shaft seals and thrust bearing, as well as, for example, travel locations of compensator flexible units (bellows, bags, etc.).

Internal component deflections such as housing stretch, shaft compression, diffuser separation, impeller/diffuser lift, and so forth, may be measured to determine mechanical operating conditions. Such measurements may be used to improve control of an ESP string, and extend run life of the ESP components.

In an implementation, an example system can include several proximity sensors located at various places in an ESP string. As an example, a sensor may be powered locally and/or through a power cables (e.g., routed from a surface location). An example, one or more sensor signals may be processed locally, routed to a main gauge unit, etc. For example, consider one or more of the sensors of the system 401 being operatively coupled to a gauge that may be fit to an end of an ESP string (see, e.g., the one or more sensors 216 and the gauge 218 of FIG. 2).

In an implementation, an example proximity sensor is located in the vicinity of the central rotating shaft with a geometrical marker located in the shaft so that it passes by the proximity sensor on each revolution (see, e.g., FIG. 5). In such an example, several "steps" may be located at the shaft (e.g., at 180, 120, 60 degrees apart). Then, the shaft revolutions per minute (rpm) can be measured by counting the steps as the shaft rotates. As an example, distance of the steps to the sensor may be used to determine shaft vibration. As explained with respect to the system 500 of FIG. 5, an array may be used or other technique to determine shaft vibration.

In an implementation, one or more proximity sensors may be used on a shaft to measure axial displacement of the shaft with respect of a housing. For example, one or more marker(s) used for rotational measurements may be used to measure axial displacement. Alternatively, a second marker may be used to improve measurement of axial displacement. As an example, sensors may be located at a single or at multiple locations along the shaft length.

A proximity sensor may be located near an impeller vane tip, for example, to count vanes as they rotate, thus determining rpm (see, e.g., FIG. 6). As an example, such a sensor may be configured to measure progressively increasing distances to the vane tips as they erode, which may provide a direct measurement of vane wear. As mentioned, an induction or other technique may provide for measurement of vane wear.

As an example, a proximity sensor may be located in a stage hydraulic seal area for measurement of a hydraulic seal gap (see, e.g., FIG. 6). As an example, a hydraulic seal gap may be a parameter that determines pump efficiency and abrades over time in the presence of solids.

As an example, a proximity sensor may be located in proximity to a diffuser stack, for example, to determine if a gap or gaps have formed in-between diffusers or above the top diffuser (see, e.g., FIG. 6).

As an example, a proximity sensor may be located in the vicinity of a compensating element (e.g., a bellows, a bag, etc.), for example, to determine extension and/or contraction of the compensating element, or the lack of expansion and contraction (see, e.g., FIG. 7).

As an example, a proximity sensor may be located near shaft seal faces, for example, for measurement of shaft seal face separation, wear, and/or skipping (see, e.g., FIG. 8).

As an example, a proximity sensor may be located near or in contact with a thrust bearing, for example, to measure lift (e.g., or lack thereof) between a thrust runner and thrust pads (see, e.g., FIG. 9).

As an example, a proximity sensor may operate in conjunction with one or more markers. As an example, a proximity sensor may operate based in part on reflection from a component. As an example, a proximity sensor may operate based in part on induction caused by a component, a marker, etc. (e.g., where induction may drive a current, generate a voltage potential, etc.).

As an example, a computing or hardware environment may provide for hosting a sensor manager. In such an example, a computing system may be implemented to monitor and analyze sensor data, and control or intervene to help provide improved operation, high reliability, and high-availability to an ESP (e.g., one or more components of an ESP, an ESP string, an ESP system, etc.).

As an example, a system may include a user interface device, for example, that can communicate via a user interface controller, which may connect with the user interface device. As an example, a network interface may provide for communication between one or more hardware components, such as, for example, sensors, valves, a multiplexer, a vibration canceling module, a VSD, etc.

As an example, a media drive/interface may accept media, such as flash drives, optical disks, removable hard drives, software products, etc. Logic, computing instructions, or a software program that includes various modules may reside on removable media readable by the media drive/interface.

As an example, a controller may control an ESP based at least in part on one or more features of the ESP. As an example, a controller may include an input for receipt of information about an ESP, which may include information as to features of the ESP. As an example, power delivered to an ESP may be ramped up, ramped down, limited, modulated, etc. based at least in part on sensed information of one or more sensors present in the ESP.

As an example, an ESP can include a shaft; an electric motor configured to rotatably drive the shaft; a housing; a stack of diffusers disposed in the housing; impellers disposed in the housing and operatively coupled to the shaft; and a proximity sensor operatively coupled to the housing. In such an example, the proximity sensor may include a shaft speed sensor. In such an example, the proximity sensor may further include a vibration sensor. As an example, an ESP may include a shaft displacement proximity sensor operatively coupled to a housing.

As an example, an ESP can include a shaft; an electric motor configured to rotatably drive the shaft; a housing; a stack of diffusers disposed in the housing; impellers disposed in the housing and operatively coupled to the shaft; and a proximity sensor operatively coupled to the housing where the proximity sensor is a vane speed sensor that directly senses speed of at least one vane of at least one of the impellers. In such an example, the proximity sensor may further include a vane wear sensor.

As an example, an ESP can include a shaft; an electric motor configured to rotatably drive the shaft; a housing; a stack of diffusers disposed in the housing; impellers disposed in the housing and operatively coupled to the shaft; and a proximity sensor operatively coupled to the housing where the shaft includes a marker and where the proximity sensor is configured to sense shaft speed based at least in part on the marker.

As an example, an ESP may include a gauge operatively coupled to a housing and configured to sense fluid properties (e.g., of fluid to be pumped by the ESP, etc.). In such an example, the ESP may include transmission circuitry for transmission of information from a proximity sensor to the gauge. Such circuitry may be communication circuitry, which may be configured for wired communication, wireless communication or wired and wireless communication.

As an example, an ESP may include a shaft; an electric motor configured to rotatably drive the shaft; a housing; a stack of diffusers disposed in the housing; impellers disposed in the housing and operatively coupled to the shaft where the impellers form hydraulic seals with respect to the diffusers; and a proximity sensor operatively coupled to the housing where the proximity sensor may be a hydraulic seal sensor. In such an example, the hydraulic seal sensor may be mounted to one of the diffusers. As an example, a hydraulic seal sensor may sense a hydraulic seal formed at an upper end of an impeller and at a lower end of a diffuser. As an example, a hydraulic seal sensor may sense a hydraulic seal formed at a lower end of an impeller and at an upper end of a diffuser.

As an example, an ESP may include a shaft; an electric motor configured to rotatably drive the shaft; a housing; a stack of diffusers disposed in the housing; impellers disposed in the housing and operatively coupled to the shaft; and a proximity sensor operatively coupled to the housing wherein the proximity sensor may be a diffuser sensor. In such an example, the diffuser sensor may sense axial displacement between at least one pair of adjacent diffusers in the stack of the diffusers.

As an example, an ESP can include a shaft; an electric motor configured to rotatably drive the shaft; a protector operatively coupled to the electric motor where the protector includes a bellows; a housing; a stack of diffusers disposed in the housing; impellers disposed in the housing and operatively coupled to the shaft; and a proximity sensor operatively coupled to the protector where the proximity sensor may be a bellows sensor (e.g., that senses one or more characteristics of the bellows). In such an example, the bellows sensor may include distance detection circuitry. As an example, a bellows sensor may include strain detection circuitry.

As an example, an ESP can include a shaft; an electric motor configured to rotatably drive the shaft; a protector operatively coupled to the electric motor where the protector includes a shaft seal; a housing; a stack of diffusers disposed in the housing; impellers disposed in the housing and operatively coupled to the shaft; and a proximity sensor operatively coupled to the protector where the proximity sensor may be a shaft seal sensor.

As an example, an ESP can include a shaft; an electric motor configured to rotatably drive the shaft; a protector operatively coupled to the electric motor where the protector includes a thrust bearing; a housing; a stack of diffusers disposed in the housing; impellers disposed in the housing and operatively coupled to the shaft; and a proximity sensor operatively coupled to the protector where the proximity sensor may be a thrust bearing sensor.

As an example, one or more methods described herein may include associated computer-readable storage media (CRM) blocks. Such blocks can include instructions suitable for execution by one or more processors (or cores) to instruct a computing device or system to perform one or more actions. As an example, a computer-readable storage medium may be a storage device that is not a carrier wave (e.g., a non-transitory storage medium).

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 12:
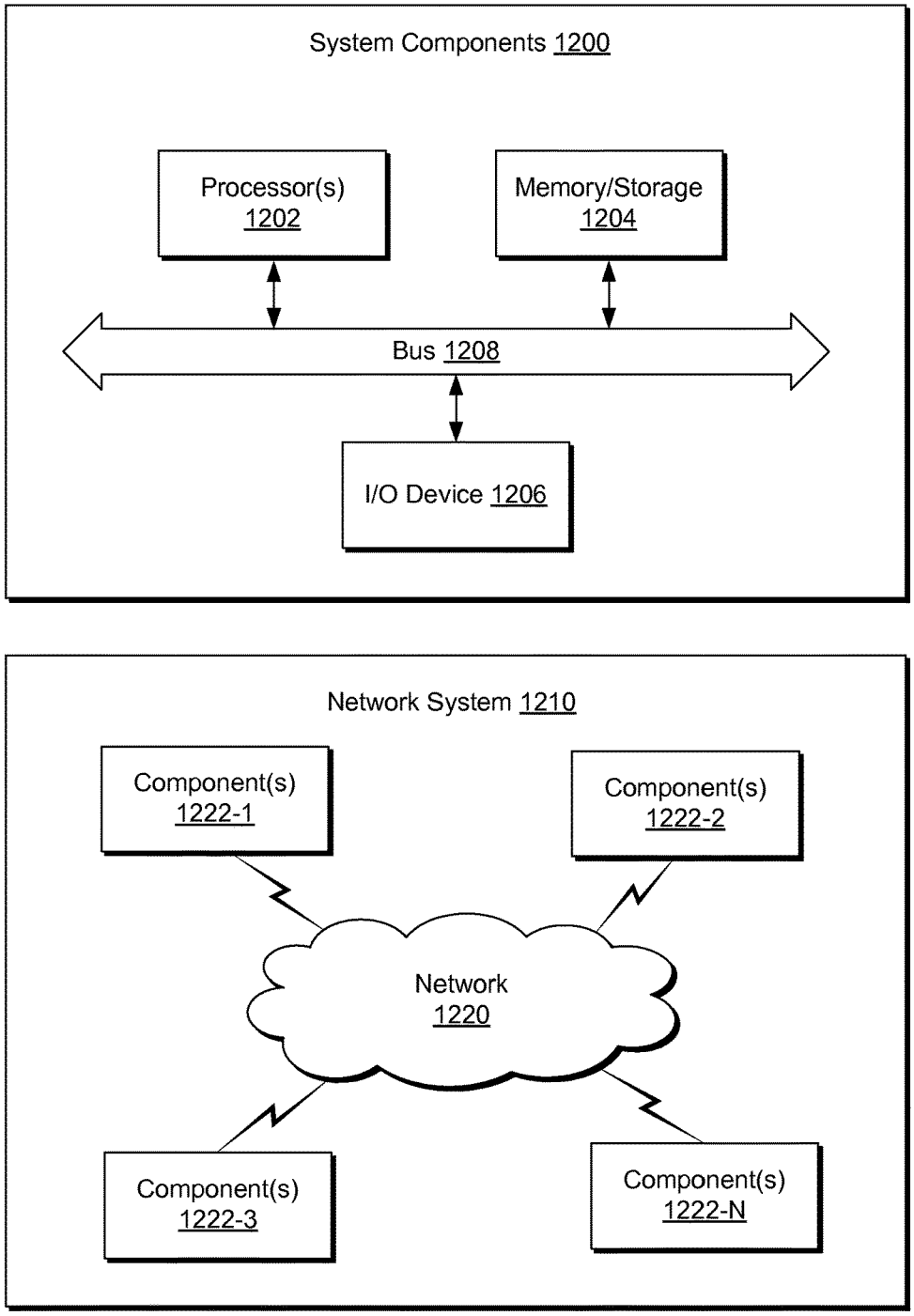
FIG. 12 illustrates example components of a system and a networked system.

FIG. 12 shows components of a computing system 1200 and a networked system 1210. The system 1200 includes one or more processors 1202, memory and/or storage components 1204, one or more input and/or output devices 1206 and a bus 1208. According to an embodiment, instructions may be stored in one or more computer-readable media (e.g., memory/storage components 1204). Such instructions may be read by one or more processors (e.g., the processor(s) 1202) via a communication bus (e.g., the bus 1208), which may be wired or wireless. The one or more processors may execute such instructions to implement (wholly or in part) one or more attributes (e.g., as part of a method). A user may view output from and interact with a process via an I/O device (e.g., the device 1206). According to an embodiment, a computer-readable medium may be a storage component such as a physical memory storage device, for example, a chip, a chip on a package, a memory card, etc.

According to an embodiment, components may be distributed, such as in the network system 1210. The network system 1110 includes components 1222-1, 1222-2, 1222-3, . . . , 1222-N. For example, the components 1222-1 may include the processor(s) 1102 while the component(s) 1222-3 may include memory accessible by the processor(s) 1202. Further, the component(s) 1202-2 may include an I/O device for display and optionally interaction with a method. The network may be or include the Internet, an intranet, a cellular network, a satellite network, etc.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An electric submersible pump (ESP) comprising:
a shaft;
an electric motor configured to rotatably drive the shaft;
a housing;
a stack of diffusers disposed in the housing;
impellers disposed in the housing and operatively coupled to the shaft wherein each of the impellers comprises vanes; and
a proximity sensor operatively coupled to the housing wherein the proximity sensor measures vane wear of one of the impellers of the ESP and directly senses speed of the one of the impellers of the ESP.

2. The ESP of claim 1 wherein the proximity sensor comprises a shaft speed sensor.

3. The ESP of claim 2 wherein the proximity sensor further comprises a vibration sensor.

4. The ESP of claim 1 wherein the proximity sensor comprises a shaft displacement sensor.

5. The ESP of claim 1 wherein the proximity sensor comprises a vane wear sensor and a vane speed sensor that directly senses speed of at least one vane of at least one of the impellers.

6. The ESP of claim 1 wherein the shaft comprises a marker and comprising another proximity sensor that is configured to sense shaft speed based at least in part on the marker.

7. The ESP of claim 1 further comprising a gauge operatively coupled to the housing and configured to sense fluid properties.

8. The ESP of claim 7 comprising transmission circuitry for transmission of information from the proximity sensor to the gauge.

9. The ESP of claim 1 wherein the proximity sensor measures progressively increasing distances to at least one vane of the impeller of the ESP as a direct measurement of wear of the at least one vane.

10. The ESP of claim 1 wherein the vane wear of the impeller is due to abrasion by solids in fluid being pumped by the ESP.

11. The ESP of claim 1 wherein the proximity sensor is locally powered.

12. An electric submersible pump (ESP) comprising:
a shaft;
an electric motor configured to rotatably drive the shaft;
a housing;
a stack of diffusers disposed in the housing;
impellers disposed in the housing and operatively coupled to the shaft wherein the impellers form hydraulic seals with respect to the diffusers and wherein each of the impellers comprises vanes; and
a proximity sensor operatively coupled to the housing wherein the proximity sensor measures vane wear of one of the impellers of the ESP and directly senses speed of the one of the impellers of the ESP.

13. The ESP of claim 12 wherein the proximity sensor is mounted to one of the diffusers.

14. The ESP of claim 12 comprising another proximity sensor that comprises a hydraulic seal sensor that senses wear of a hydraulic seal formed at an upper end of one of the impellers and at a lower end of one of the diffusers.

15. The ESP of claim 12 comprising another proximity sensor that comprises a hydraulic seal sensor that senses wear of a hydraulic seal formed at a lower end of one of the impellers and at an upper end of one of the diffusers.

16. The ESP of claim 12 comprising another proximity sensor that comprises a diffuser sensor.

17. The ESP of claim 16 wherein the diffuser sensor senses axial displacement between at least one pair of adjacent diffusers in the stack of the diffusers.

18. The ESP of claim 12 wherein the proximity sensor measures progressively increasing distances to at least one vane of the impeller as a direct measurement of vane wear.

19. The ESP of claim 12 wherein the wear of the component is due to abrasion by solids in fluid being pumped by the ESP.

20. An electric submersible pump (ESP) comprising:
a shaft;
an electric motor configured to rotatably drive the shaft;
a housing;
a stack of diffusers disposed in the housing;
impellers disposed in the housing and operatively coupled to the shaft;
a proximity sensor operatively coupled to the housing;
a gauge operatively coupled to the housing and configured to sense fluid properties; and
transmission circuitry for transmission of information from the proximity sensor to the gauge.

* * * * *